United States Patent [19]

Wehmeyer

[11] Patent Number: 4,883,005

[45] Date of Patent: Nov. 28, 1989

[54] SEWING MACHINE WITH A TENSIONING DEVICE HAVING A PLURALITY OF TENSIONING ROLLERS

[75] Inventor: Bodo Wehmeyer, Bielefeld, Fed. Rep. of Germany

[73] Assignee: Durkoppwerke GmbH, Fed. Rep. of Germany

[21] Appl. No.: 313,099

[22] Filed: Feb. 21, 1989

[30] Foreign Application Priority Data

Feb. 18, 1988 [DE] Fed. Rep. of Germany ..... 3805029

[51] Int. Cl.[4] ..... D05B 35/06; D05B 35/10

[52] U.S. Cl. ..... 112/63; 112/121.26; 112/153; 112/305; 112/306

[58] Field of Search ..... 112/63, 121.26, 121.27, 112/153, 305, 306, 121.15, 2, 318, 322

[56] References Cited

U.S. PATENT DOCUMENTS 4,467,734 8/1984 Rohr ..... 112/63

4,602,579 7/1986 Pollmeier et al. ..... 112/121.26

4,827,856 5/1989 Rohr ..... 112/306

*Primary Examiner*—Peter Nerbun

*Attorney, Agent, or Firm*—Ostrolenk, Faber, Gerb & Soffen

[57] ABSTRACT

In order to permit a reliable alignment, in the direction transverse to the direction of rotation, of the edge 5 of the opening of a tubular workpiece 4 of medium-heavy to heavy sewing material which is drawn with considerable pre-tension over a tensioning device 3, each of the tensioning rollers 6, 7, 8 belonging to the tensioning device 3 has at least three alignment members 15 distributed uniformly over its circumference. Each alignment member 15 has an engagement side with a gripping surface. After optically scanning the edge 5 of the opening of the workpiece 4, one or more of the alignment members are displaced by a pulsating action of a pressure fluid, radially and axially, in the tensioning roller 6, 7, 8. In this way, the gripping surfaces of the alignment members 15 grip the inner side of the tubular workpiece 4 and displace it transversely to its direction of rotation.

19 Claims, 5 Drawing Sheets

SEWING MACHINE WITH A TENSIONING DEVICE HAVING A PLURALITY OF TENSIONING ROLLERS

BACKGROUND OF THE INVENTION

The present invention relates to a tensioning device including a plurality of tensioning rollers disposed to receive and align tubular workpieces, and at least one sensor which is disposed to scan the edge of the opening of the workpiece; at least one tensioning roller having alignment members which are movable transverse to their direction of rotation to automatically align the edge of the opening with respect to a sewing point.

A tensioning device for sewing machines having at least two drivable tensioning parts to receive and align tubular workpieces is described in Federal Republic of Germany Pat. No. 3,117,198, the disclosures of which are expressly incorporated by reference herein. Two electric motors arranged coaxially in the tensioning part are provided in the embodiment disclosed therein, for driving the tensioning part and for further driving the alignment members. In this known embodiment the alignment members are formed of a plurality of gear wheels which are mounted in slots in a support part belonging to the tensioning part, so that they extend in planes that are radial to the axis of rotation of the tensioning part. In this axis of rotation there is provided a central worm gear with which the said gear wheels engage. The electric motor provided for the driving of the alignment members drives the worm gear and thus the gear wheels. The latter are so arranged in the support part that the outwardly directed circumferential portions of the outside diameter of each gear wheel extend beyond the outside diameter of the tensioning part. The tubular workpiece is pulled over the tensioning parts belonging to the tensioning device so that the circumferential portions of the aforementioned gear wheels which extend beyond the tensioning part grip the workpiece on its inner side, namely in the vicinity of the edge of the opening. The tensioning part which is driven by the corresponding electric motor causes the tubular workpiece which has been pulled on to rotate. In this connection its opening edge is scanned by a sensor, for instance a light barrier. Deviations from a desired position are transmitted to a control by which the electric motor intended for the drive of the alignment members—an adjustable-speed DC motor rotating in one direction of rotation as well as, after reversal of polarity, in the other—is controlled and the worm gear thus travels in the clockwise and counterclockwise directions respectively. The known tensioning device therefore permits a movement of a tubular workpiece which is aligned in accordance with the scanned edge of the opening. Since the alignment members do not permit an increase in the diameter of the corresponding tensioning part, the known tensioning device can be used only for light, elastic sewing material, such as tricot fabrics.

For independently controlled alignment of the edge of the opening of a tubular workpiece consisting of medium-heavy, heavy, and less elastic sewing material, for instance the closed waistband of jeans or the like, the known tensioning device is unsuitable for the following reasons:

1. It is impossible to increase the diameter of the tensioning parts, and because of the nonoptimally developed points of engagement of the alignment members which act on the workpiece during the alignment.

2. The electric motor provided for the drive of the alignment members, because of its relatively small size predetermined by the outside diameter of the corresponding tensioning part, is not able to exert, via the alignment members, such large forces on the tubular workpiece, which has been tensioned with considerable initial tension, as are necessary in order to assure dependable alignment, effected transverse to the direction of rotation, of the scanned edge of the opening, particularly under the condition that the tubular workpiece is not transported by the sewing machine but solely by the tensioning device in accordance with the invention.

SUMMARY OF THE INVENTION

Accordingly, the primary object of the invention is to improve upon a tensioning device of the type in question so as to permit reliable alignment to be effected transverse to the direction of rotation of the edge of the opening of a tubular workpiece of medium-heavy, heavy, and less elastic sewing material which is drawn with considerable initial tension over the tensioning device.

This object is achieved, in part, by providing each tensioning roller with a plurality of alignment members distributed about its periphery for engaging the workpiece, being both radially and axially displaceable with respect to the periphery of the tensioning roller.

By the arrangement of the alignment members in the tensioning rollers according to the invention, as well as by the pressure-fluid-actuatable radial and axial displacement of the alignment members, their outer sawtooth surfaces engage strongly, while slightly increasing the outside diameter of the tensioning roller, on the inside of the tensioned workpiece and thus makes it possible, even in the case of heavy sewing material, to dependably align the opening edge transverse to the direction or rotation of the tubular workpiece.

BRIEF DESCRIPTION OF THE DRAWINGS

One embodiment of the invention will be explained below with reference to the drawings, in which.

DETAILED DESCRIPTION OF THE DISCLOSED EMBODIMENT

Figure 1:
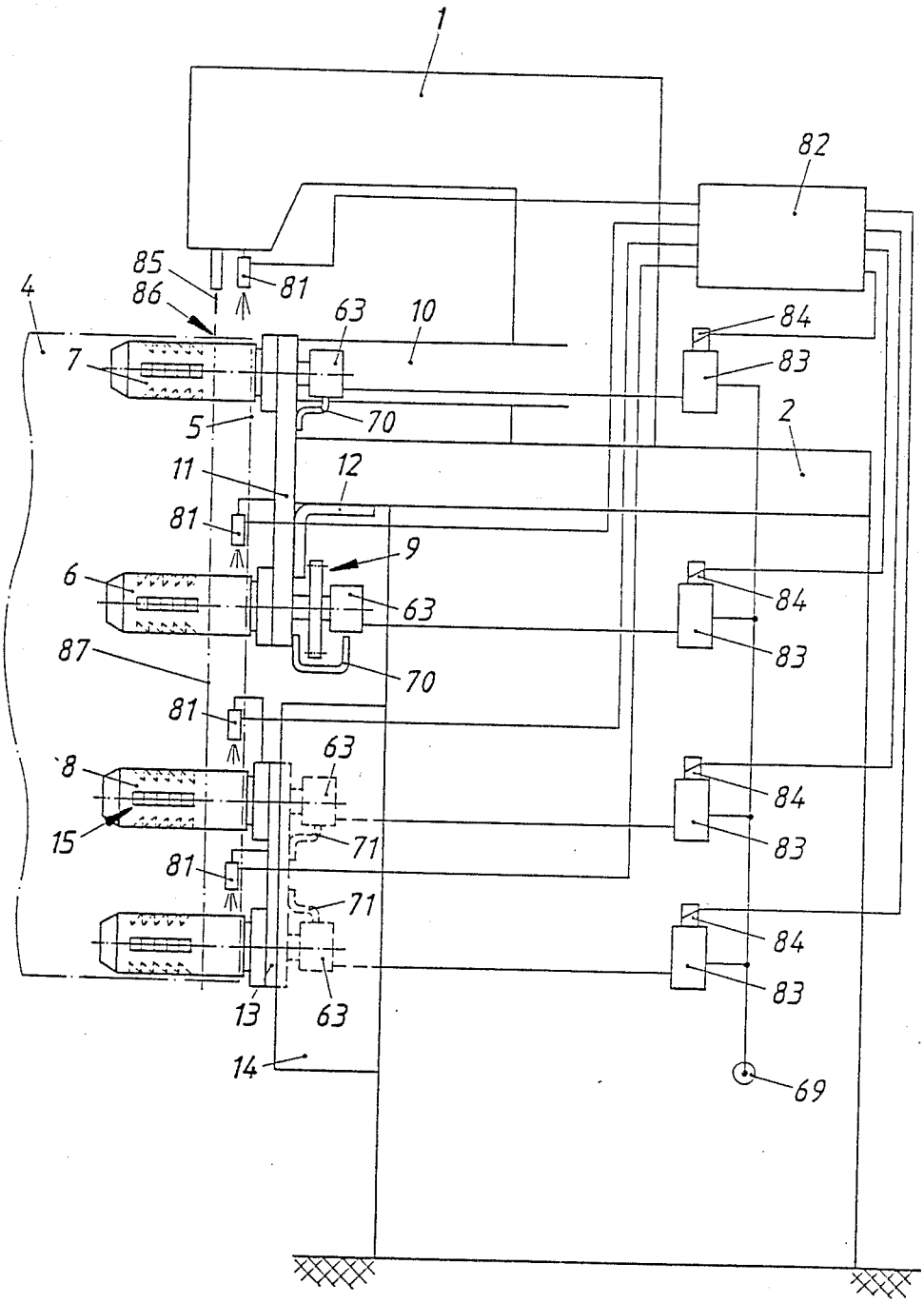
FIG. 1 is a simplified side view of a sewing machine having a tensioning device comprising eight tensioning rollers.

FIG. 1 shows a double-lockstitch short-seam automatic sewing machine 1 of customary construction which is mounted on a frame 2 and cooperates with a known loop feed device (not shown) and with a tensioning device 3 for receiving, with simultaneous tensioning, a tubular workpiece 4 and for automatically aligning the edge 5 of its opening at the correct position.

A known automatic sewing machine generally comprising the foregoing components is described in Federal Republic of Germany Pat. No. 3,335,936, the disclosure of which is expressly incorporated by reference herein. This machine, in particular, substantially automatically sews belt loops on trousers or skirts that have a waistband width which differs from workpiece to workpiece. The extremely economical manner of operation of this automatic sewing machine results from the fact that the distance from belt loop to belt loop is automatically adjusted in accordance with the specific waistband width of the tensioned workpiece. We can dispense here with a further description of the construction and manner of operation of this known automatic sewing machine since that can be noted from Federal Republic of Germany Pat. No. 3,335,936. This known automatic sewing machine has the disadvantage that it does not dependably and automatically align the edge of the opening on the tensioned tubular workpiece transverse to the direction of rotation.

In order to remedy this defect, the tensioning device 3 disclosed herein has at least three tensioning rollers or groups of tensioning rollers generally designated 6, 7, 8, each such group including at least one tensioning roller.

Figure 2:
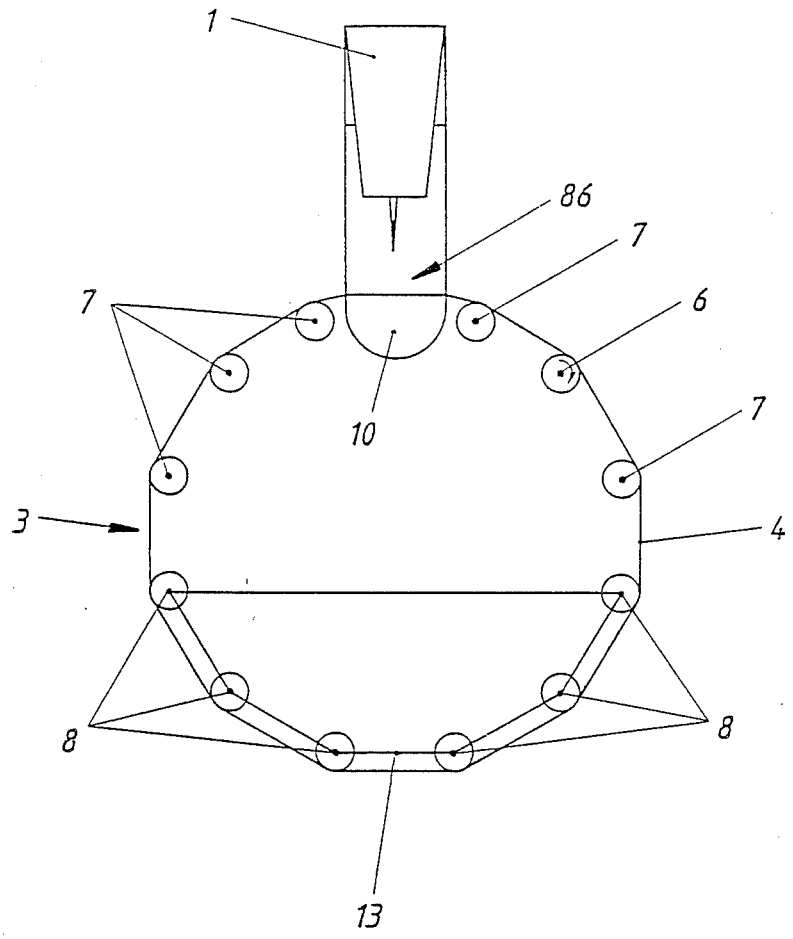
FIG. 2 is a greatly simplified front view for illustrating the manner of operation of the tensioning device, having twelve tensioning rollers in this case.
Figure 3:
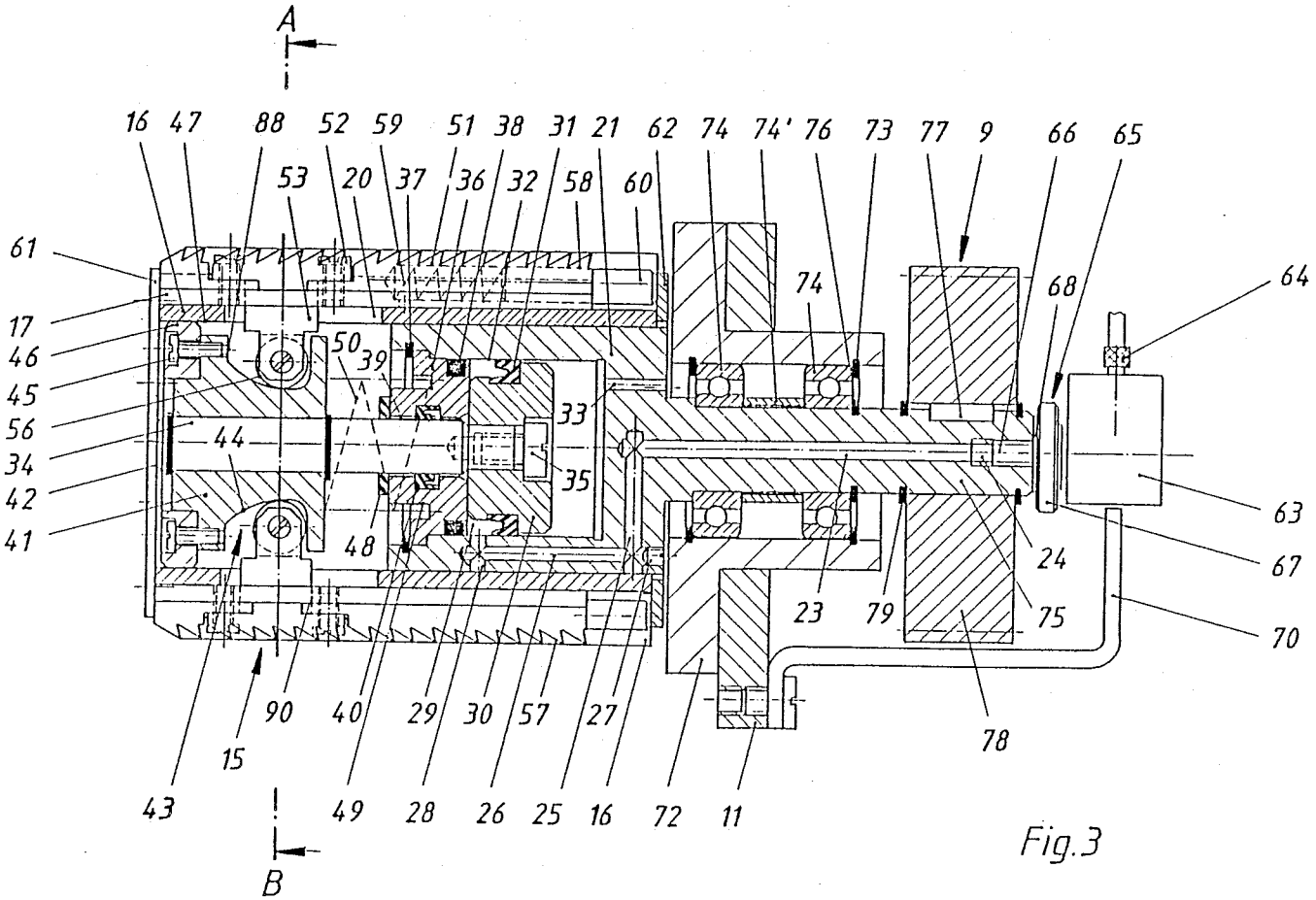
FIG. 3 is a sectional view through a driven tensioning roller, the alignment members of which have a sawtooth surface directed towards the right.

A fixed, driven tensioning roller 6, shown in FIGS. 1 to 3, is driven by an external drive 9, for instance a gear-wheel transmission. The driven tensioning roller 6, and at least two additional fixed, non-driven tensioning rollers 7, are arranged as shown in FIG. 2 in the immediate vicinity of a free arm 10 located on the short-seam automatic sewing machine 1, and are fixed in position relative to the short-seam automatic sewing machine 1. The tensioning device 3 furthermore includes at least one additional non-fixed tensioning roller 8 which is displaceable with respect to the short-seam automatic machine 1.

The tensioning device 3 shown in FIG. 2 has five stationary tensioning rollers 7, a driven stationary tensioning roller 6, and six tensioning rollers 8 which are not fixed in position. The stationary tensioning rollers 6, 7 are mounted in a plate 11 is connected firmly frame 2, for instance by an angle bracket 12. The non-stationary tensioning roller or rollers 8 are mounted in a vertically movable carriage 13 which, in its turn, is received by a bearing pedestal 14 fastened to the frame 2.

Further description of the displaceability of the carriage 13 can also be dispensed with here since it has been explained in detail in Federal Republic of Germany Pat. No. 3,335,936.

Figure 4:
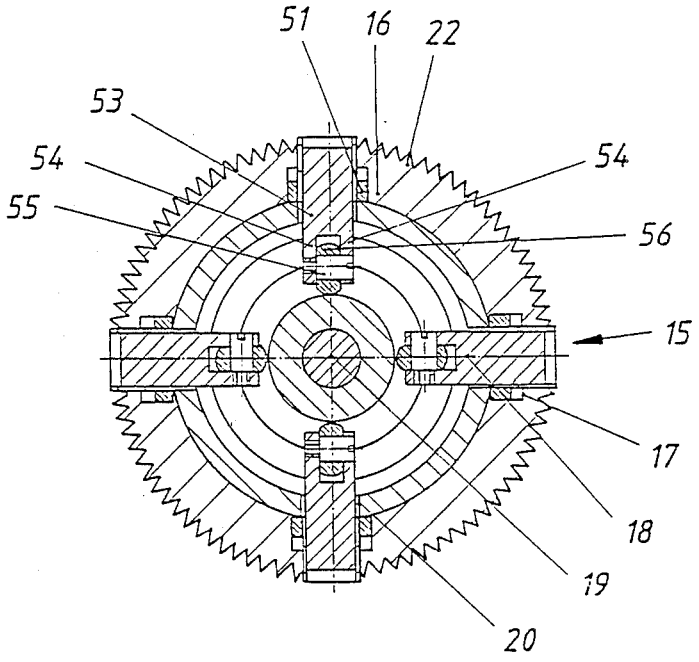
FIG. 4 is a sectional view taken along line A-B of FIG. 3.

Each tensioning roller 6, 7, 8 includes at least three alignment members 15 which are distributed uniformly over its circumference and which, as shown in FIG. 4, are accommodated in T-shaped grooves 17 which are formed in a sleeve 16. The axis of symmetry 18 of each alignment member 15 is directed towards a center point 19 of the tensioning roller 6, 7, 8. Also formed in the sleeve 16 are openings 20 arranged concentrically to each groove 17.

Referring now to FIGS. 3 and 4, the driven tensioning roller 6 comprises a cylindrical tube 21 and the sleeve which is firmly fastened to it by bonding or soldering. The outer surface 22 of the sleeve 16 has a ridged or toothed configuration. Means for the entry and emergence of pressure fluid are also provided. An axial first bore hole 23, with a threaded hole 24 at its inlet end, is formed within the cylindrical tube 21. Into the first bore hole 23 there debouches a second bore hole 25 which is penetrated by a third bore hole 26 which extends parallel to the axis of symmetry of the cylindrical tube 21. The entrance side of the bore hole 26 is closed by an ordinary commercial threaded pin 27, leakage losses of the pressure fluid, for instance compressed air or hydraulic pressure fluid, being avoided by an additional bonding. The bore hole 26 is finally penetrated by a transverse fourth bore hole 28. Since, as previously mentioned, the sleeve 16 is rigidly connected to the cylindrical tube 21 by bonding or soldering, leakage losses from the bore holes 25, 28 are definitely avoided.

Through the said bore holes 23, 25, 26, 28, pressure fluid is fed into the cylindrical tube and passes into a cylindrical space 29 and, as will be understood from FIG. 3, causes axial displacement of a piston 30 which is provided with an ordinary commercial lip ring and is received by a cylindrical blind hole 32 within the cylindrical tube 21. By the installed position of the lip ring 31, which can be noted from FIG. 3, the piston 30 is sealed off from the blind hole 2. Air compressed upon the axial displacement of the piston 30 is allowed to emerge through a vent bore 33 provided in the cylindrical tube 21.

A piston rod 34 is firmly attached to the piston 30 by a screw 35. The blind hole 32 is closed by a cover 36 which is connected in known manner by an ordinary locking ring 37 in form-locked manner to the cylindrical tube 21. An O-ring 38 provided in the cover 36 serves to seal off the cover 36 from the blind hole 32. In the axis of symmetry of the cover 36 there is provided a hole 39 the diameter of which is greater than the outside diameter of the piston rod 34, which avoids any jamming of the piston rod in the hole. Another lip ring 40 is provided in the hole 39 and is installed in such position that it cooperates with the aforementioned O-ring 38 to prevent leakage losses of the pressure fluid present in the cylinder space 29.

On the free end of the piston rod 34 a cam ring 41 is provided which is held in form-locked manner between two ordinary locking rings 42 so that it cannot shift axially on the piston rod 34. The locking rings 42 are received in known manner by corresponding circular grooves in the piston rod 34. The ring 41 has a notch 43 with curved runout 44.

On the ring 41 a guide ring 46 is fastened by a screw 45 and is easily displaceable along an inner wall 47 of the sleeve 16. Between the ring 41 and the cover 36 there is provided at least one damping disc 48 which is gently struck by the ring 41 when the ring 41 moves toward the cover 36. Over an extension 49 which is provided concentric to the axis of symmetry of the cover 36 there is placed a compression spring 50, one end of which rests on the cover 36 and the other end of which rests on the ring 41.

Figure 5:
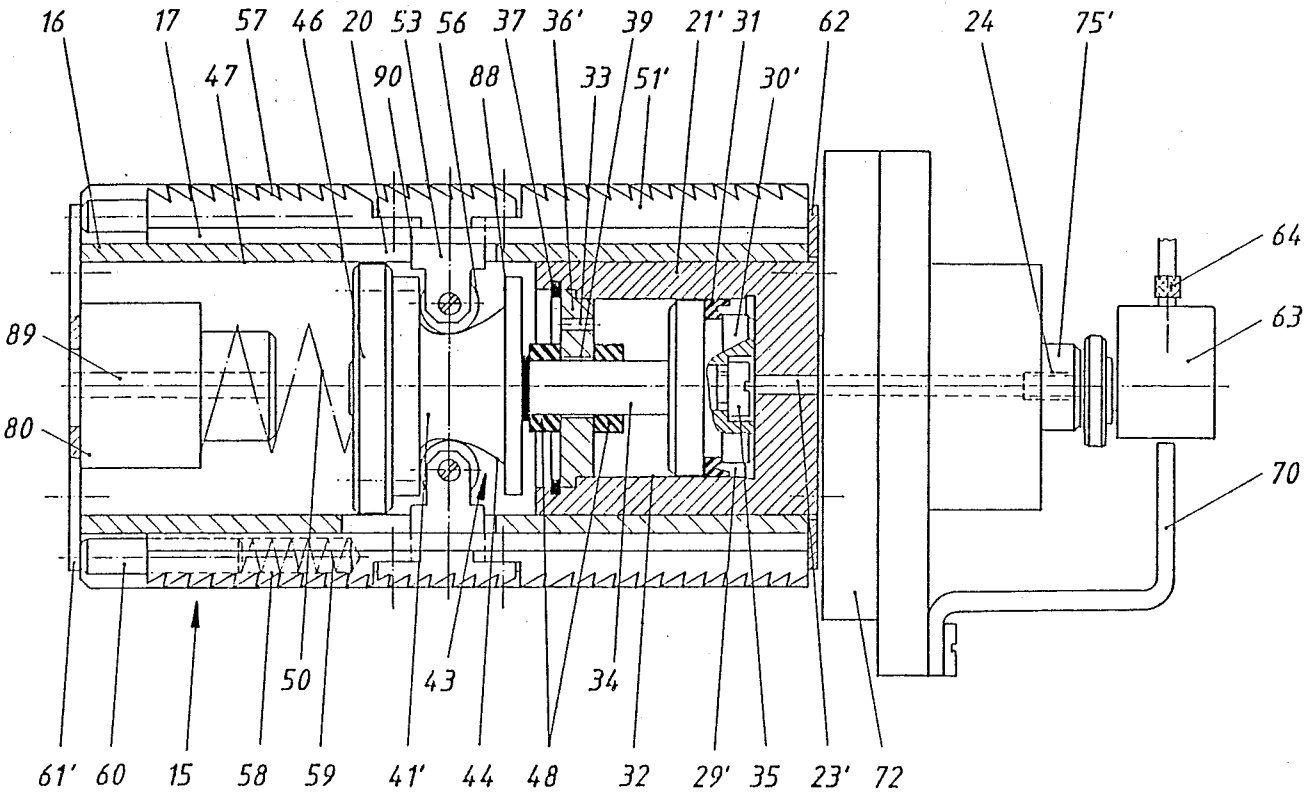
FIG. 5 is a sectional view of a non-driven tensioning roller, the alignment members of which have a sawtooth surface which is directed towards the left.

Each non-driven tensioning roller 7, 8, as shown in FIG. 5, is provided with alignment members 15 the sawtoothing 57 of which is directed towards the left (away from the frame 2) in contradistinction to the tensioning rollers 6 which can be noted in FIG. 3. Therefore, the non-driven tensioning rollers 7, 8 are, in part, of different construction than the one shown in FIG. 3. In FIG. 5, the cylindrical tube 21' has a bore hole 23' for the entry and emergence of pressure fluid, on the entrance side of which hole there is also provided a threaded hole 24. From here, the pressure fluid passes into a cylinder space 29', which pushes a piston 30' axially toward the left (away from the frame 2). By the position of insertion of the lip ring 31 which can be noted from FIG. 5, the piston 30' is sealed off against a blind hole 32. On the free end of a piston rod 34 which is rigidly connected to the piston 30' there is provided a cam ring 41' which, like the ring 41 described above, is mounted on the piston rod 34. The curved runout 44 of the notch 43 in the ring 41' is a mirror image of the runout in the ring 41 shown in FIG. 3.

The left-hand side of the tensioning roller 7, 8 shown in FIG. 5 is covered by a closure cover 61' to which a bolt 80 is firmly attached by soldering, welding or bonding. An extension provided on the bolt receives the compression spring 50, which is arranged between the bolt 80 and the ring 41'. By a vent hole 9 provided in the bolt 80, the air which is compressed by the ring 41' upon its moving to the left can escape towards the outside.

The alignment members 15 received by the T-shaped grooves 17 in FIGS. 3 and 5 each comprise a feeder 51, 51' and a bearing pedestal 53. In the feeder 51, 51' there is provided an opening 90 through which the bearing pedestal 53 is passed, as shown in FIG. 3 or 5. The bearing pedestal 53 is then fastened to the respective feeder 51, 51' by means of a screw 52. On the bearing pedestal 53 there are provided two legs 54 which receive between them in known manner a roller 56 which is turnable around a shank screw 55. The feeder 51, 51' has, as shown in FIG. 4, a T-shaped cross section and on its engagement (outer) side has a gripping surface 57, preferably with a sawtoothed configuration.

Parallel to the sawtoothed surface and within the feeder 51, 51' is a blind hole 58 which, as shown in FIGS. 3 and 5, receives a compression spring 59 and a bolt 60.

The outwardly directed face side of each tensioning roller 6, 7, 8 is covered by a closure cover 61, 61' and the other face is covered by a closure ring 62, the closure cover 61, 61' as well as the closure ring 62 being fastened to the sleeve 16 by countersunk screws (not shown here) in known manner. In this way, the bolt 60 and the compression spring 59 are prevented from falling out of the feeder 51, 51'. By the force exerted by the compression spring 59 on the corresponding feeder 51, 51' the result is obtained that the tooth points of the sawtooth surface 57 emerge from the corresponding tensioning roller 6, 7, 8 immediately upon the start of the axial displacement of the feeder 51, 51'.

The two legs 54 on each feeder 51, 51' extend through an opening 20, whereby the roller 56 comes into contact with the curved runout 44 of the notch 43 in the ring 41, 41'.

Each tensioning roller 6, 7, 8 has an ordinary rotary distributor 63 for feeding pressure fluid into the cylindrical tube 21, 21'. A pressure-fluid feed line is connected to the distributor 63, via a threaded hose fitting 64. The rotary distributor 63 has a rotating outlet. For the latter there is provided an outlet fitting 65 mounted rotatably in the rotary distributor 63. A threaded pin 66 of the outlet fitting 65 can be screwed into the threaded hole 24 in a bearing pin 75, 75' (which communicates with the first bore hole 23, 23' as discussed previously) by turning a flange 67 having a rough surface. A sealing disc 68 on the threaded pin 66 avoids leakage losses of the pressure fluid, which is supplied by a pressure-fluid source 69.

Each rotary distributor 63 is held in position secured against turning. In this connection, the respective rotary distributor 63 arranged on each of the stationary tensioning rollers 6, 7 is held secured against turning by an angle bracket 70 fastened on the plate 11. The rotary distributor 63 arranged on each of the non-stationary tensioning rollers 8 is held against turning by an angle bracket 71 fastened on the carriage 13 (FIG. 1).

Each tensioning roller 6, 7, 8 is mounted in a bearing ring 72 (FIG. 3), in which there are arranged two antifriction bearings 74 between locking rings 73, another ring 74'0 holding the two antifriction bearings 74 spaced from each other.

The inner races of the bearings 74 receive the bearing pin 75 of the cylindrical tube 21 and the bearing pin 75' of the cylindrical tube 21', in which connection a further locking ring 76 forced into a corresponding groove in the bearing pin 75, 75' connects the tensioning roller 6, 7, 8 in form-locked manner to the mounting ring 72. The bearing rings 72 of the stationary tensioning rollers 6, 7 are mounted in the plate 11 and those of the nonstationary tensioning rollers 8 are mounted in the carriage 13.

As shown in FIG. 3, the bearing pin 75 of the driven tensioning roller 6 is longer than the bearing pin 75' of the non-driven tensioning rollers 7, 8, one of which is shown in FIG. 5. At the end of the longer bearing pin 75 a drive member 78 is mounted, fixed against rotation, to the cylindrical tube 21, for instance by a key 77. The drive member 78 is secured in the axial direction by two further locking rings 79 on the bearing pin 75. The drive member 78, for instance a gear or a toothed-belt pulley, is driven in known manner by an external drive. Since the latter has already been described and shown in Federal Republic of Germany Pat. No. 3,335,936, further description can be dispensed with here.

In order to permit a dependable alignment of the edge 5 of the opening of the workpiece 4 it is advisable for the tensioning device 3 to have an even number of tensioning rollers 6, 7, 8 and furthermore for adjacent tensioning rollers, for instance 6, 7 or 6, 7, 8, to be provided with feeders 51, 51', whose sawtooth surfaces 57 are directed in opposite directions (see FIG. 1).

In some situations, depending on the sewing material of the tubular workpiece 4 pulled onto the tensioning rollers 6, 7 8, it is possible that the trousers waistband, for example, tensioned in this manner will tend to drift in only one direction off the tensioning rollers 6, 7, 8. This tendency is further increased by the very weight of the overhanging trousers, which pulls on the tensioned waistband and thereby tends to pull it off from the tensioning rollers 6, 7, 8. In such a case, in a simplified embodiment the tensioning device 3 need only be provided with tensioning rollers 6, 7, 8 whose feeders 51 have a sawtooth surface 57 which is directed only in the direction opposite the direction of drift.

As shown in FIG. 1, each tensioning roller 6, 7, 8 of the tensioning device 3 has a sensor 81, preferably a reflex light barrier, associated with it. In this way, the edge 5 of the opening of the workpiece 4 pulled onto the tensioning rollers 6, 7, 8 is scanned in a known manner. By interrogating the sensors 81, switching signals are provided to a control 82. With each rotary pressure fluid distributor 63 there is associated an ordinary 3/2-way solenoid valve 83 whose magnet coil 84 is connected, as shown in FIG. 1, by circuitry to the control 82. All of the 3/2-way solenoid valves 83 are connected in known manner at their input sides to the source of pressure fluid 69.

The manner of operation of the tensioning device of the invention will be described below:

The tubular workpiece 4, which is pulled onto the tensioning rollers 6, 7, 8 and in known manner has been brought for sewing between the feed dog and the lifted presser foot of the short-seam automatic sewing machine 1, is moved intermittently by the driven tensioning roller 6, during pauses in the operation of the short-seam automatic sewing machine 1 whose sewing needle 85 lies outside the workpiece 5. This movement, which has been described in detail in Federal Republic of Germany Pat. No. 3,335,936, will not be taken up further here.

It is important for the workpiece 4 to be transported by sections with its edges in correct position, i.e., at a well-defined distance from a sewing point 86. In order to make this possible, the edge 5 of the opening of the tubular workpiece 4 is scanned by the plurality of sensors 81 in accordance with FIG. 1. If one of the sensors 81 detects that the opening edge 5 has not yet reached its desired position, for example if the distance from the opening edge 5 to a plane 87 which passes through the sewing point 86 is too small, then pressure fluid is provided for a short time, and therefore in pulsating manner, to the cylindrical tube 21 of the tensioning roller 6, 7, 8 associated with that particular sensor 81.

In this way, the piston 30 shown in FIG. 3, for example, and with it the cam ring 41, move to the right, as a result of which the rollers 56 are moved radially outwards with respect to the axis of symmetry of the tensioning roller 6. In this connection the tooth points of the sawtooth surface 57 are extended beyond the outer circumferential surface defined by the cylindrical sleeve 16 and grip the inside of the tensioned workpiece 4. When the rollers 56 have been moved the furthest possible distance away from the axis of symmetry of the tensioning roller 6, then contact occurs between a point on the circumference of the travel roller 56 and a flank 88 of the notch 43. Since the aforementioned action of the pressure fluid on the cylindrical tube 21 still continues, the cam ring 41, which is still moving further to the right, now displaces the feeder 51 in axial direction towards the right.

At the end of this axial displacement, the corresponding 3/2-way solenoid valve 83 is reversed in known manner, as a result of which the pressure fluid present in the cylindrical tube 21 escapes to the outside. Under the influence of the compression springs, which now relax, namely the compression spring 0 and the further compression spring 59 provided in each feeder 51, the piston 30 as well as the cam ring 1 are brought back to the left into their starting position. At the same time, the tensioned workpiece 4 presses the feeders 51 back into the sleeve 16.

If, upon further scanning of the edge 5 of the opening of the workpiece 4 by the corresponding sensor 81 it is noted that it has still not assumed its desired position, then the corresponding cylindrical tube 21 is briefly acted upon again by the fluid in the manner described above, as a result of which a further axial displacement of the workpiece 4 towards the right is carried out. If another sensor 81, which is associated with the adjacent tensioning roller in the direction of travel of the workpiece 4, then notes that, within its scanning region, the edge 5 of the opening is outside its desired position, then the cylindrical tube 21' of the corresponding tensioning roller shown in FIG. 5 is now acted on by the pressure fluid. In this way, its feeders 51', which are provided with a leftward-directed sawtooth surface 57, displace the tensioned workpiece 4 towards the left in the region of the particular tensioning roller.

On the basis of the three partial displacements of the workpiece 4 in the axial direction of the corresponding tensioning rollers, in the example which has just been described, the principle of the alignment process effected transverse to the direction of rotation of the workpiece 4 can be noted. Actually, all tensioning rollers 6, 7, 8 belonging to the tensioning device 3, as well as the sensors 81 associated with them, may participate in the alignment process. The pulsating action of pressure fluid on all cylindrical tubes 21 and 21' contained in the tensioning rollers 6, 7, 8 makes possible a rapid-reacting, sensitive and thus precise alignment of the edge 5 of the opening of the tensioned workpiece 4

I claim:

1. A sewing machine having a tensioning device including a plurality of tensioning rollers disposed to receive and align tubular workpieces, and at least one sensor which is disposed to scan an edge of an opening of the workpiece; at least one tensioning roller having alignment members which are movable transverse to the direction of rotation thereof; said alignment members cooperating with said sensor and with a control unit for the automatically controlled alignment of the opening edge with respect to a sewing point;

wherein each tensioning roller has at least three alignment members distributed about its periphery for engaging said workpieces, said alignment members being displaceable both radially and axially with respect to the periphery of the tensioning roller.

2. A sewing machine as in claim 1, wherein said alignment members are distributed uniformly about said tensioning rollers.

3. A sewing machine as in claim 1, wherein said alignment members are form-lock mounted in said tensioning rollers.

4. A sewing machine as in claim 1, wherein said tensioning rollers further comprise means for receiving a pressure fluid and displacing said alignment members in response thereto.

5. A sewing machine as in claim 4, further comprising a distributor for receiving pressure fluid from an external source; such pressure fluid being supplied to said tensioning rollers by a rotary outlet fitting on said distributors which rotates with said tensioning rollers; said distributor being braced against a stationary portion of said sewing machine so as not to rotate with said tensioning rollers.

6. A sewing machine as in claim 1, wherein an axis of symmetry of each alignment member is in an imaginary plane which passes through a central axis of the tensioning roller.

7. A sewing machine as in claim 1, wherein the tensioning device has an even number of at least four tensioning rollers, and the alignment members of each two adjacent tensioning rollers are axially displaceable in opposite axial directions.

8. A sewing machine as in claim 1, wherein the tensioning device has at least three tensioning rollers and the alignment members of all the tensioning rollers are axially displaceable in the same axial direction.

9. A sewing machine as in claim 1, wherein each tensioning roller includes a cylindrical tube and a sleeve firmly connected to it; the cylindrical tube has bore hole means for the entry and the emergence of the pressure fluid; a cylindrical blind hole means for receiving such fluid; and vent bore hole means for venting said cylindrical blind hole.

10. A sewing machine as in claim 9, wherein the sleeve has at least three T-shaped grooves distributed uniformly over its peripheral surface for accommodating said alignment members.

11. A sewing machine as in claim 9, wherein ridges are formed over the outer peripheral surface of said sleeve and over the entire width.

12. A sewing machine as in claim 9, wherein said cylindrical blind hole receives a piston which is actuatable by such pressure fluid; a piston rod actuated by the piston extends out of said blind hole and to cam means which is axially movable within said tube between an actuated position and a rest position; said cam means engaging said aligning members for axially and radially displacing the same.

13. A sewing machine as in claim 12, further comprising compression spring means for resisting movement of said cam means into said actuated position.

14. A sewing machine as in claim 12, further comprising means for damping the movement of said cam means into said actuated position.

15. A sewing machine as in claim 12, wherein said cam means comprises a ring having a circumferential notch with a curved runout surface whereby said notch has a variable circumference at said runout surface.

16. A sewing machine as in claim 15, wherein each said alignment member comprises a feeder which has an outer engagement surface for engaging and gripping the workpiece; and a bearing pedestal at a radially inner portion thereof; said bearing pedestal having bearing means for engaging said cam means and for thereby displacing said feeder radially outward when said cam means is moved to its actuated position.

17. A sewing machine as in claim 16, wherein said bearing means comprises a roller on said bearing pedestal which engages said runout of said cam ring.

18. A sewing machine as in claim 16, wherein a compression spring is disposed between said feeder and said cylindrical tube for resisting axial movement of said feeder.

19. A sewing machine as in claim 18, wherein a first portion of said feeder is connected to said bearing pedestal and movable radially with respect to the rest of said feeder;

wherein movement of said cam means toward said actuated position initially causes said first portion to move radially of the rest of said feeder; and then causes the entire said feeder to move axially against the action of said compression sparing.

* * * * *